United States Patent [19]

Dill et al.

[11] 4,160,543

[45] Jul. 10, 1979

[54] HEAT TREATMENT OF WELDS

[75] Inventors: Herbert C. Dill; Allen E. Wisler, both of Houston, Tex.

[73] Assignee: Hughes Tool Company, Houston, Tex.

[21] Appl. No.: 854,963

[22] Filed: Nov. 25, 1977

Related U.S. Application Data

[60] Continuation of Ser. No. 741,006, Nov. 11, 1976, abandoned, which is a division of Ser. No. 524,919, Nov. 18, 1974, Pat. No. 3,997,374, which is a continuation of Ser. No. 269,648, Jul. 7, 1972.

[51] Int. Cl.[2] ..... C21D 1/10

[52] U.S. Cl. ..... 266/252; 266/258; 266/259

[58] Field of Search ..... 266/114, 127, 251, 258, 266/259, 128, 129, 252; 228/231; 219/8.5, 10.57

[56] References Cited

U.S. PATENT DOCUMENTS

| | | | |
|---|---|---|---|
| 2,009,078 | 7/1935 | Ziska | 266/259 |
| 2,218,958 | 10/1940 | Nelson | 266/114 |
| 2,288,038 | 6/1942 | Somes | 219/10.57 |
| 2,556,236 | 6/1951 | Strickland | 266/129 |
| 2,623,836 | 12/1952 | Noren | 266/127 |
| 3,294,599 | 12/1966 | Huseby | 148/143 |
| 3,407,099 | 10/1968 | Schell | 148/143 |
| 3,458,922 | 8/1969 | Schellstede et al. | 228/231 |
| 3,622,138 | 11/1971 | Kostyal | 219/10.57 |

*Primary Examiner*—Gerald A. Dost
*Attorney, Agent, or Firm*—Robert A. Felsman

[57] ABSTRACT

Apparatus for heat treating the weld and heat affected zone between a steel pipe and a steel connector, the apparatus including an induction coil to heat the weld and weld heat affected zone to a selected temperature. A ring shaped manifold having nozzle means to direct flow outwardly is connected with pumping means to pump gas simultaneously against the interior and exterior of the weld and heat affected zone.

6 Claims, 5 Drawing Figures

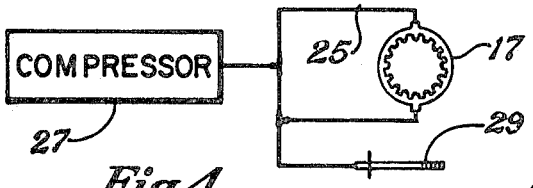
Fig.4
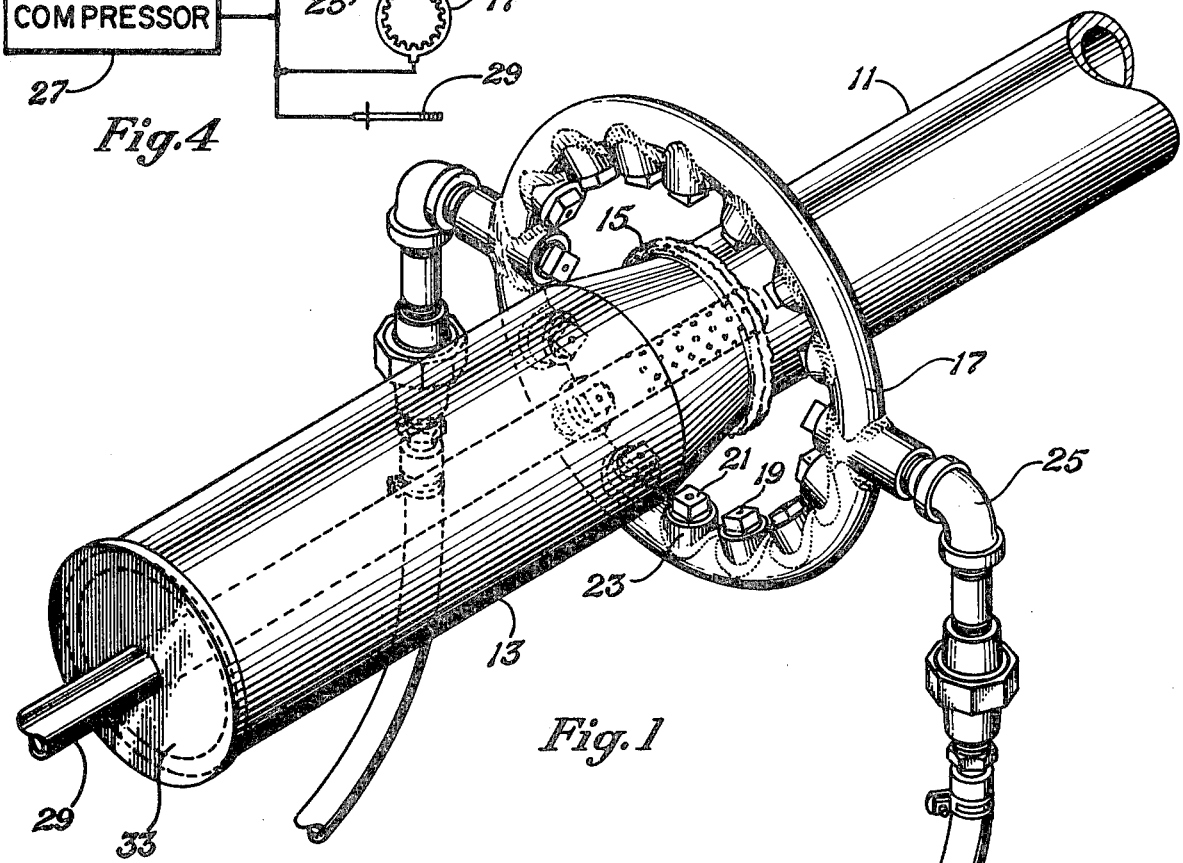
Fig.1
Fig.2
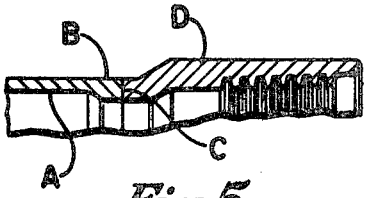
Fig.5
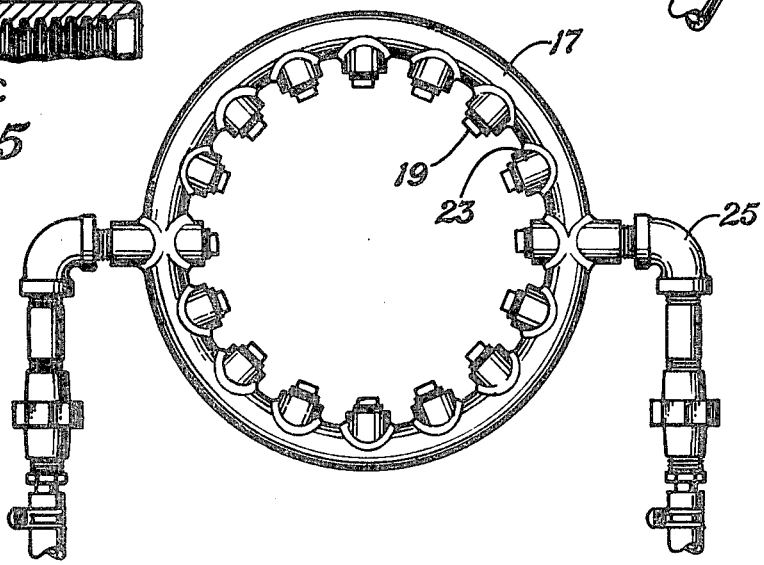
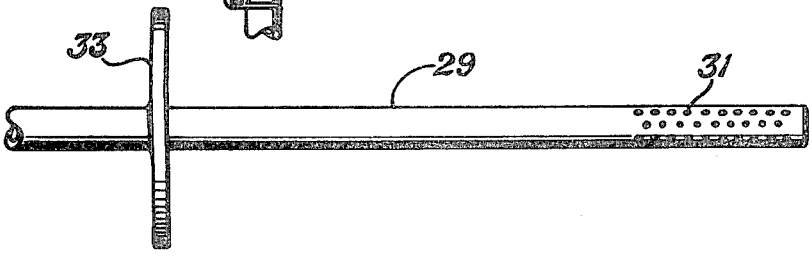
Fig.3

HEAT TREATMENT OF WELDS

CROSS REFERENCE TO RELATED APPLICATION

This is a continuation of application Ser. No. 741,006, filed Nov. 11, 1976, now abandoned, which was a division of application Ser. No. 524,919, filed Nov. 18, 1974, now U.S. Pat. No. 3,997,374, which was a continuation of application Ser. No. 269,648, filed July 7, 1972.

BACKGROUND OF THE INVENTION

1. Field of the Invention

This invention relates in general to the post welding heat treatment of the welds of tubular members. It is especially suitable for increasing the strength in the weld and the heat affected zone to produce an overall strength that at least matches that of the body of the tubular member.

2. Description of the Prior Art

It is common to use electrical resistance (flash-butt) welding to join tubular members such as drill pipe and their rotary connectors, called "tool joints," in the oil well drilling industry. It is important that the weld and the heat affected zone be able to carry as high a tensile load and be able to withstand fatigue stresses or impacts as well as the pipe used in the assembly. Otherwise, the weld or the heat affected zone may not have adequate load carrying capability and may fail when subjected to the severe stresses commonly encountered during oil well drilling.

With reference to FIG. 5, a drill pipe A usually has an area B of increased cross-section on each end called an upset, which is welded at C to a tool joint D. It is possible to have a lower yield strength of the metal in the heat affected zone of weld C than in the body A of the pipe and still have greater overall strength in the weld and heat affected zone. This is due to the larger cross-sectional area in upset B as compared with the smaller cross-sectional area of the non-upset portion or body A of the pipe. Typical ratios of an upset B cross-sectional area to the pipe body A cross-sectional areas may range from 1.38 to 2.10 for commercially available assemblies. In some of the high strength pipe assemblies the load carrying capability of the heat affected zone around the weld C does not compare favorably with that of the pipe or tool joint when utilizing the prior art heat treatments such as normalizing and tempering the weld. In one prior art example, a 3½ inch diameter 15.50 pound, S-135 drill pipe had a yield strength of 89,900 psi in the heat affected zone of upset B that was heat treated by normalizing and tempering, whereas the body A of the pipe had a yield strength of 140,000 psi. The ratio of the cross-sectional areas of the upset portion B of the pipe to the body A of the pipe was 1.42 to 1. With the pipe having a yield strength of 140,000 psi, a minimum yield strength of 99,000 psi is required in the heat affected zone of the upset B to essentially match the load carrying capability of the pipe. Using a safety factor of 10%, then the minimum yield strength of the heat affected zone should be at least 110,000 psi. The prior art method of normalizing and tempering the heat affected zone has been found incapable of producing such a yield strength in the heat affected zone.

The problem is more difficult than simply increasing the hardness of the weld and heat affected zone. Hardening too fast leads to the formation of cracks. Further, excessive hardness and brittleness leads to failures.

SUMMARY OF THE INVENTION

The invention may be summarized as method and apparatus for heat treating welds such that their overall strengths match those of the pipe bodies to which they are connected. To accomplish this result, a post welding heat treatment is provided that includes quenching the weld and heat affected zone at a cooling rate that is limited to produce an appropriate level of hardness without cracking. Too rapid cooling may result in cracking and too slow cooling will not provide the proper hardness level. For the relatively thick sections of pipe to which tool joints are welded for oil well drilling, air quenching is preferably performed on the exterior, as well as in the interior, circumferential surfaces of the weld. As a consequence, the entire cross-sectional thickness of the weld and heat affected zone is hardened satisfactorily, without cracking. For best results, the post welding treatment includes cooling the weld to a selected temperature, reheating and quenching, and then tempering.

Apparatus for performing the method comprises a ring shaped manifold with nozzle means spaced along the periphery to direct the flow of gaseous fluid inwardly. A mandrel means for insertion inside the tool joint and pipe has nozzle means to direct the flow of gaseous fluid outwardly.

Other objects, features and advantages of the invention will become apparent in the following detailed description.

BRIEF DESCRIPTION OF THE DRAWING

FIG. 1 is a perspective view as seen obliquely from one end of a pipe and tool joint, with a ring shaped manifold and mandrel positioned to direct the flow of gaseous fluid against the heat affected zone of a weld in accordance with the principles of the invention;

FIG. 2 is an end view of a ring shaped manifold, nozzle means and connections of the form also shown in FIG. 1;

FIG. 3 is a side elevation view of the mandrel shown in FIG. 1;

FIG. 4 is a schematic diagram of a pneumatic circuit for supplying gaseous fluid to the manifold and mandrel; and FIG. 5 is a fragmentary side elevation view in longitudinal section of one-half of a tool joint and the end of an upset drill pipe to which it has been welded.

DESCRIPTION OF THE PREFERRED EMBODIMENT

Referring initially to FIG. 1 of the drawing, a pipe 11 has secured to one end of a connection member or tool joint 13 by means of a weld 15, generally formed by the electrical resistance (flash-butt weld) technique. This welding technique is well known, having been utilized for decades for such purposes as connecting tool joints to drill pipe used in rotary well drilling.

A ring shaped manifold 17 is shown positioned concentrically about the weld 15. A plurality of nozzle means 19 are secured to the inner periphery of the manifold, which has in this instance the geometric form known as the torus. Such nozzle means here is an element with a polygon shaped head through which extends an orifice 21. The lower end of each element is preferably threaded for releasable attachment to a nozzle element pedestal 23 secured to the manifold. As shown, the nozzle elements are closely spaced along the inner periphery of the manifold such that the discharge of gaseous fluid from the orifices 21 tends to impinge against the entire circumferential area of the heat affected zone generated during welding.

Suitable connections 25 are utilized so that a gaseous fluid may be transmitted by a compressor 27 to the manifold, and also to a mandrel or probe 29 adapted for insertion within the tool joint 13 and end of pipe 11. The probe is preferably concentrically aligned with the tool joint such that its nozzle means or orifices 31 are equidistant from the tool joint. Here, as with the manifold, the number and spacing of the nozzle means is selected such that the gaseous fluid tends to flow against the entire circumferential area of the interior surface of the weld 15. The term "nozzle means" is used in its broadest sense to cover orifices, nozzles or any other form of openings through which a fluid may be directed.

For the purpose of controlling the axial position of the orifices 31 of mandrel 29 relative to the weld 15, a positioner means 33 is used. Here the positioner is in the form of a shoulder secured to a mid-region of the mandrel 29 to extend radially outward into engagement with the extremity of the tool joint 13.

The method of the invention may be practiced by utilizing the pump 27, manifold 17, and mandrel 29 for pumping a fluid transversely against the exterior and interior circumferential surfaces of the weld 15.

The following is a specific example of one way in which the method was successfully practiced:

A joint of the previously described 3½ inch, 15.50 pound, S-135 steel pipe, having a yield strength of approximately 140,000 psi, was welded to a tool joint of AISI 4137H steel by the flash-butt welding method. The ends of the pipe had an upset region B having a cross-sectional thickness greater than the cross-sectional thickness of the body A of the pipe by a ratio of 1.42 to 1.

Next, the heat affected zone was cooled to below 125° F.

Then, the assembly was heated in an induction coil to a temperature from about 1750° to 1800° F. The induction coil is of dimensions for heating the weld and heat affected zone to a temperature in this range.

Thereafter, the manifold 17 and mandrel 29 were positioned approximately as shown in FIG. 1 to pump a gaseous fluid, that in this instance was air at a temperature of about 100° F., transversely against the interior and exterior circumferential surfaces of the weld. The pressure above the mandrel and manifold was 53 psig and the time of cooling was 1¼ minutes. The manifold had a total of sixteen, drilled orifices for nozzle means, eight of which were 7/64 inch diameter and evenly spaced to direct fluid perpendicular with the pipe longitudinal axis. The other eight orifices were ⅛ inch diameter holes inclined at 7½° relative to the longitudinal axis of the pipe. The mandrel was constructed of thin wall tubing of 1.050 inch outside diameter and 0.824 inch inside diameter. There were 56 drilled orifices, half of which were 7/64 inch diameter and half ⅛ inch diameter, all evenly spaced circumferentially and over a length of 4¼ inches in order to direct fluid uniformly and perpendicularly against the weld and inner pipe surface.

Finally, the assembly was tempered to a temperature of 1175° F.

As a result of using the above method and apparatus, the yield strength of the weld and heat affected zone increased from 89,900 to 120,500. Since the minimum yield strength acceptable in the upset area B is 110,000 psi after utilization of a safety factor of 10%, the treatment successfully increased the strength of the heat affected zone to a satisfactory value.

In the above described preferred embodiment, the weld must be initially cooled below the transformation temperature but need not be cooled to a temperature as low as 125° F. for satisfactory results under all conditions. Such cooling may be accomplished by discharging water at normal hydrant temperatures in a stream that impinges on the pipe circumferentially about 8 inches from the weld. After thus cooling, the weld and heat affected zone may be heated by suitable means such as an induction coil to a satisfactory pre-quenching temperature preferably above the upper critical such as that specified. This temperature must be above the lower critical to obtain any beneficial results. The quenching by air as described lowers the temperature to below about 600° F. at a cooling rate that avoids the formation of extremely brittle structures that are likely to crack. Air is not the only fluid that will accomplish this result. Some liquids such as oils or other suitable quenchants are capable of accomplishing a satisfactory result, although not with exactly the same cooling rate. After suitable tempering the metal in any instance must have a minimum yield strength that produces an overall strength in the weld area comparing favorably with that of the pipe.

It should be apparent from the foregoing that an invention has been provided having significant advantages. Through utilization of the method, the strength of the weld and heat affected zone may be increased to a level at least matching that of the body of the pipe. Further, the hardness of the heat affected zone is obtained in a manner that avoids cracks and is easily controlled. It has been found that the time duration of the air quenching is not critical so long as a satisfactory minimum such as 1¼ minutes is used for the example given. This is especially advantageous in high production manufacturing since some variations in timing may be expected.

While the invention has been shown in only one of its forms, it should be apparent to those skilled in the art that it is not so limited, but is susceptible to various changes and modifications without departing from the spirit thereof. The term fluid therefore encompasses liquids that meet the above requirements. The term gaseous fluid includes gasses that may include a mist such as steam. Modifications to the method steps and to the specific manner of carrying out the method will become apparent to those skilled in the art in view of the previous description, as will modifications to the form of apparatus.

I claim:

1. An apparatus for heat treating the weld and heat affected zone between a steel pipe and a steel connector, the apparatus comprising the combination of:

a generally ring shaped manifold;

nozzle means carried by the manifold to direct flow inwardly;

a mandrel;

nozzle means carried by the mandrel to direct fluid flow outwardly;

positioner means for controlling the axial position of the nozzle means of the mandrel so that it discharges flow against the weld and heat affected zone, and for maintaining the mandrel stationary with respect to the pipe during quenching;

heating means for heating the weld and heat affected zone, to a selected temperature across the entire cross-sectional thickness of the weld and heat affected area for hardening the entire cross-sectional thickness of the weld and heat affected zone; and pumping means connected with the ring shaped manifold and the mandrel to supply gaseous fluid thereto for quenching the weld and heat affected area.

2. Apparatus defined by claim 1 in which said manifold is generally in the shape of a torus having nozzle elements positioned on the interior periphery thereof to direct air toward the center line of the torus.

3. The apparatus defined by claim 1 in which mandrel is tubular, having a plurality of nozzles circumferentially to direct air transversely to the longitudinal axis of the mandrel.

4. An apparatus for heat treating the weld and heat affected zone between a steel pipe and a steel connector, the apparatus comprising the combination of:

a generally ring shaped manifold for encircling the weld and heat affected zone;

nozzle means carried by the manifold to direct flow inwardly onto the weld and heat affected zone;

a mandrel for insertion in the pipe, and nozzle means carried by the mandrel to direct flow outwardly onto the weld and heat affected zone;

positioner means for controlling the axial position of the nozzle means of the mandrel so that it discharges flow against the weld and heat affected zone, and for maintaining the mandrel stationary with respect to the pipe during quenching;

an induction coil means for heating the weld and heat affected zone across the entire cross-sectional thickness of the weld and heat affected zone, to a pre-quenching temperature for hardening the entire cross-sectional thickness of the weld and heat affected zone, and to heat said zone to said pre-quenching temperature; and a compressor connected with the ring shaped manifold and the mandrel to supply air thereto for quenching the area heated by the induction coil.

5. An apparatus for heat treating the weld and heat affected zone between a drill pipe and a tool joint, the apparatus comprising the combination of:

a generally ring shaped manifold for encircling the weld and heat affected zone;

nozzle means carried by the manifold on its interior periphery to direct flow inwardly onto the weld and heat affected zone;

a tubular mandrel, for inserting in the tool joint and pipe, having nozzle means circumferentially carried by the mandrel to direct flow outwardly onto the weld and heat affected zone;

positioner means cooperating with the mandrel, for controlling the axial position of the nozzle means of the mandrel so that it discharges flow against the weld and heat affected zone, and for maintaining the mandrel stationary with respect to the pipe during quenching;

an induction coil means for heating the weld and heat affected zone across the entire cross-sectional thickness of the weld and heat affected zone to a temperature in the range from 1750° F. to 1800° F. for hardening the entire cross-sectional thickness of the weld and heat affected zone, and to heat said zone to said temperature; and a compressor connected with the ring shaped manifold and the mandrel to supply air thereto for quenching the area heated by the induction coil.

6. The apparatus defined by claim 5 in which the positioner means comprises a shoulder secured to the mandrel at a distance from the nozzle means substantially equal to the distance from the end of the tool joint to the weld and heat affected area, the shoulder extending radially outward into engagement with the end of the tool joint.

* * * * *